US006795976B1

(12) United States Patent
van der Sleesen

(10) Patent No.: US 6,795,976 B1
(45) Date of Patent: Sep. 28, 2004

(54) VENTILATING PANEL AND POCKET ASSEMBLY FOR A GARMENT

(76) Inventor: Michael van der Sleesen, 23 S. Kingman St., Lakeville, MA (US) 02347-1821

( * ) Notice: Subject to any disclaimer, the term of this patent is extended or adjusted under 35 U.S.C. 154(b) by 0 days.

(21) Appl. No.: 10/654,331

(22) Filed: Sep. 3, 2003

(51) Int. Cl.[7] ..... A41D 27/28
(52) U.S. Cl. ..... 2/69; 2/DIG. 1
(58) Field of Search ..... 2/69, 85, 93, 94, 2/97, 115, 227, 228, 244, 102, 108, DIG. 1, 247–254, 164, 159, 209.5, 400, 401, 408, 409, 104; D2/839, 857

(56) References Cited

U.S. PATENT DOCUMENTS 1,725,520 A * 8/1929 Kaplan ..... 2/209.5
2,010,434 A * 8/1935 Langrock ..... 2/93
2,019,980 A * 11/1935 Krauss ..... 106/665
2,073,711 A * 3/1937 Robinsohn ..... 2/126
2,079,980 A * 5/1937 Anders ..... 2/115
2,084,173 A * 6/1937 Wexler ..... 2/87
2,713,168 A * 7/1955 Bagnato ..... 2/93
2,715,226 A * 8/1955 Weiner ..... 2/79
2,716,754 A * 9/1955 Hirsch ..... 2/227
3,045,243 A * 7/1962 Lash et al. ..... 2/1
3,086,215 A * 4/1963 Di Paola ..... 2/93
3,153,793 A * 10/1964 Lepore ..... 2/93
3,761,962 A * 10/1973 Myers ..... 2/79
3,921,224 A * 11/1975 Ingram, III ..... 2/93
4,004,294 A * 1/1977 Pinch ..... 2/104
4,408,356 A * 10/1983 Abrams ..... 2/87
4,513,451 A * 4/1985 Brown ..... 2/69
4,608,715 A * 9/1986 Miller et al. ..... 2/1
4,665,563 A * 5/1987 Harvey ..... 2/87
4,722,099 A * 2/1988 Kratz ..... 2/79
4,731,883 A * 3/1988 Foster ..... 2/69
4,924,613 A * 5/1990 Levin ..... 40/586
5,105,477 A * 4/1992 Golde ..... 2/93
5,201,075 A * 4/1993 Svetich ..... 2/108
5,507,042 A * 4/1996 van der Slessen ..... 2/69
5,642,526 A * 7/1997 Thompson ..... 2/79
5,664,256 A * 9/1997 Blauer et al. ..... 2/69
5,704,064 A * 1/1998 van der Sleesen ..... 2/69
5,794,267 A * 8/1998 Wallace ..... 2/227
5,845,336 A * 12/1998 Golde ..... 2/93
5,870,777 A * 2/1999 Hans ..... 2/238
5,878,441 A * 3/1999 Busker et al. ..... 2/247
5,884,338 A * 3/1999 Golde ..... 2/247
D414,913 S * 10/1999 Katz et al. ..... D2/829
5,970,516 A * 10/1999 Shimooka ..... 2/69
6,070,274 A * 6/2000 van der Sleesen ..... 2/456
6,085,353 A * 7/2000 van der Sleesen ..... 2/69
6,163,883 A * 12/2000 Hong ..... 2/69
6,263,510 B1 * 7/2001 Bay et al. ..... 2/93
6,339,845 B1 * 1/2002 Burns et al. ..... 2/243.1
6,473,908 B1 * 11/2002 Bontems ..... 2/227
6,687,919 B2 * 2/2004 Dilworth et al. ..... 2/457
2003/0033656 A1 * 2/2003 Jaeger ..... 2/69

* cited by examiner

*Primary Examiner*—John J. Calvert
*Assistant Examiner*—Alissa L. Hoey
(74) *Attorney, Agent, or Firm*—McDermott Will & Emery LLP

(57) ABSTRACT

A ventilating panel for a garment includes an air impervious sheet which defines an interior void region, a first at least partially air permeable sheet extending from and spanning the void region, and a second at least partially air permeable sheet having opposing side edges and a bottom edge coupled respectively to the peripheral portions of the interior void region. The first air permeable sheet and the second air permeable sheet form a pocket with an opening defined by the top portion of the interior void region and the top edge of the second air permeable sheet. A flexible air impervious cover sheet includes a top edge fixedly coupled to the second air permeable sheet, and two side and a bottom edges adapted for releasable coupling to the peripheral edges of the second air permeable sheet.

9 Claims, 5 Drawing Sheets

VENTILATING PANEL AND POCKET ASSEMBLY FOR A GARMENT

FIELD OF THE INVENTION

The present invention relates to ventilated garments, and, in particular, to a ventilating panel and pocket assembly for a garment.

BACKGROUND OF THE INVENTION

When operating fast moving, relatively open vehicles such as motorcycles, bicycles, and some aircraft, the use of protective apparel is important. However, to be useful, protective apparel must be comfortable enough to wear. Many of the garments commonly used for such applications, such as leather suits and jackets, are unacceptably uncomfortable because they provide poor ventilation. Poor ventilation can be a serious problem during warm or moderate weather.

Wearing poorly ventilated protective apparel is uncomfortable on warm days because poor ventilation causes excessive heat buildup. As a result, the wearer may discard the apparel on warm days. Alternatively, the wearer may partially unfasten the front of the garment to provide some ventilation. However, wearing an unfastened garment can be hazardous when traveling at high speed. Air trapped by the opened garment causes billowing or ballooning of the garment and generates unstable forces on the wearer.

Ventilation systems for protective garments are known in the art. For example, U.S. Pat. No. 4,608,715 issued to Miller et al. discloses a vented garment having a linear closure element, e.g., a zipper, provided on the garment, with an air permeable material extending in a rough "C" shape from the edges of the closure element. The vents are adjustably opened by an associated zipper. With the vents opened, the garment would distort in use, providing a poor fit to the wearer. U.S. Pat. No. 4,513,451 issued to Brown discloses a garment with openings that are spanned by a stretchable mesh fabric. Variable closure elements adjustably cover the openings to permit selective control of the effective area of the opening, and thus selective control over the air flow through the opening. The Brown garment does provide effective ventilation; however, because of the stretchable nature of the mesh fabric, it provides a relatively poor fit to the wearer.

U.S. Pat. No. 4,722,099 to Kratz discloses a ventilated protective garment having mesh vents at various locations on the garment, particularly at locations requiring little protection, such as the armpits and throat. Air scoops in the garment allow airflow into the mesh vents and through the garment. The Kratz garment does not, however, permit the wearer to selectively control the amount and location of ventilation.

It is therefore an object of the present invention to provide a ventilating panel for a garment with an improved ventilation system.

It is also an object of the invention to provide a ventilating panel for a garment that offers increased comfort and simplicity of design.

It is a further object of the invention to provide a ventilating panel for a garment with an adjustable ventilation system that provides increased ventilation over the body of the wearer.

Other objects and advantages of the present invention will become apparent upon consideration of the appended drawings and description thereof.

SUMMARY OF THE INVENTION

The present invention provides a ventilating panel and pocket assembly for a garment. According to one aspect of the present invention, the panel is preferably made of an air impervious sheet and includes an interior void region, which forms a venting opening allowing air to pass through the panel. The interior void region is defined by a border, which includes two opposing side portions, a top portion extending between first ends of the two opposing side portions, and a bottom portion extending between the second ends of the two opposing side portions. In a preferred embodiment, the interior void region has a substantially rectangular shape. The interior void region also can be defined with other shapes, for example, a trapezoidal shape.

A first at least partially air permeable sheet spans the interior void region. The peripheral edges of the air permeable sheet are attached to the side, top and bottom portions of the interior void region by stitches or by other means. The first air permeable sheet is made of an air permeable material, such as a mesh or otherwise perforated material, which admits air into and out of the garment.

A second at least partially air permeable sheet is attached to the panel, preferably along portions of the border of the first air permeable sheet, forming a pocket with the first at least partially air permeable sheet. The second air permeable sheet includes two opposing edges coupled to the two opposing side portions of the interior void region, and a bottom edge coupled to the bottom portion of the interior void region. The top edge of the first air permeable sheet and the top edge of the second air permeable sheet define an opening for the pocket formed by the two sheets. The second sheet can be entirely air permeable or partially air permeable, and also is made of a mesh or other air permeable materials.

In one preferred embodiment, the pocket is provided with peripheral panels. The peripheral panels include two side panels and one bottom panel. The two side panels are connected to the two opposing side edges of the second sheet and the two opposing side portions the interior void region. The bottom panel is connected to the bottom edge of the second sheet and the bottom portion of the interior void region. The first air permeable sheet, the second air permeable sheet, and the peripheral panels form the pocket, which has a height H. The height H can vary as desired. The peripheral panels are preferably air impermeable.

The panel also includes a flexible air impervious cover sheet disposable over the second air permeable sheet. The cover sheet includes a top edge fixedly coupled to the second air permeable sheet near the top edge thereof. The cover sheet also includes two opposing side edges and a bottom edge adapted for releasable coupling respectively to the side edges and the bottom edge of the second air permeable sheet by a closure assembly, when the cover sheet overlies the second air permeable sheet. The closure assembly is preferably a hook and loop fastener, or a zipper, such that the cover sheet may be selectively attached to or offset from the side edges or bottom edge of the second air permeable sheet to adjust the venting area of the venting opening, thus to regulate the air flow into and through the garment. The closure assembly is preferably water proofed.

The panel further includes a flap extending from the top portion of the border of the interior void region to a distal end. A fixation assembly is disposed on the distal end of the flap and the cover sheet at the back side, which faces the second air permeable sheet when the cover sheet overlies the second air permeable sheet. When the cover sheet is rolled up, to adjust the venting area of the venting opening, the cover sheet is attached to the flap by the fixation assembly. In one preferred embodiment, the fixation assembly includes a hook and loop fastener. In an alternative form, the fixation assembly uses a magnetic fastener, instead of a hook and loop fastener. Other fasteners may be used as well.

The arrangement of the panel and the pocket assembly combines a ventilation system with a storage pocket, thus providing the wearer with an increased comfort and convenience.

The panel and the pocket assembly with air venting system is preferably used in jacket as illustrate in the figures, but the panel described herein are also applicable to any type of garment, including, for example, pants, vests, leggings, chaps, gloves, and full-body suits.

BRIEF DESCRIPTION OF THE DRAWINGS

For a fuller understanding of the nature and the objects of the invention, reference should be made to the following detailed description and the accompanying drawings in which like reference numerals refer to like elements and in which.

DETAILED DESCRIPTION OF THE PREFERRED EMBODIMENT

Figure 1:
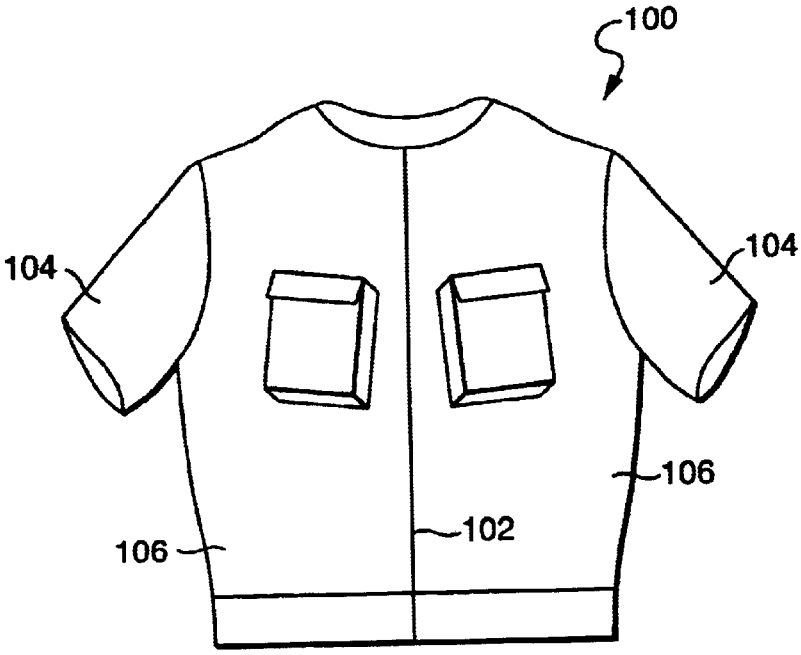
FIG. 1 shows a front view of a jacket having ventilating panels and pocket assemblies according to one preferred embodiment of the present invention.
Figure 2:
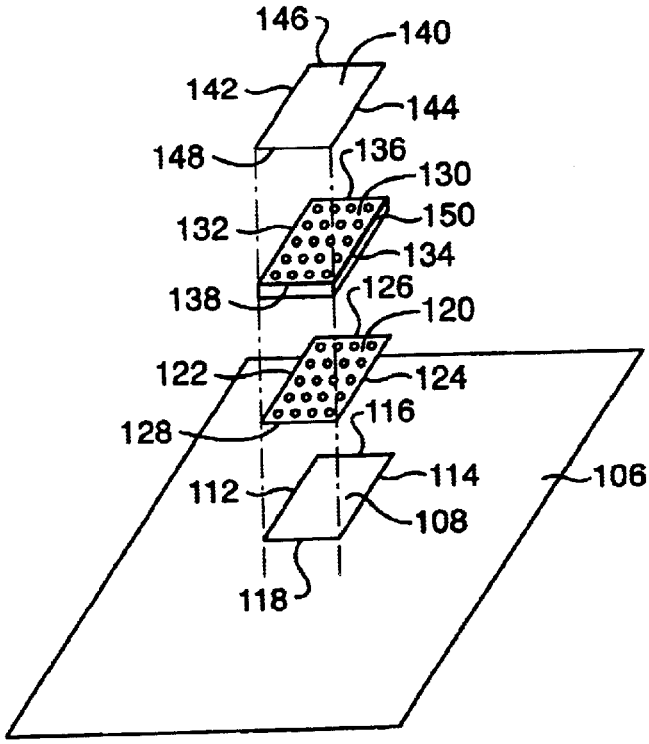
FIG. 2 shows an exploded schematic view of a ventilating panel and pocket assembly according to one preferred embodiment of the present invention.
Figure 2A:
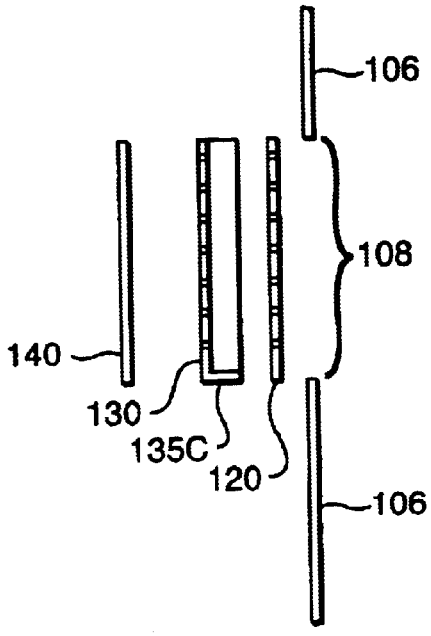
FIG. 2A shows a side exploded view of the ventilating panel and pocket assembly shown in FIG. 2.
Figure 2B:
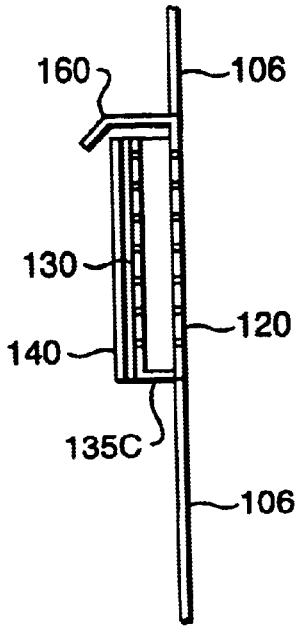
FIG. 2B shows a side view of the ventilating panel and pocket assembly of FIG. 2, with the exploded sheets attached together, forming a pocket.

FIG. 1 shows a front view of a jacket 100, which is equipped with a central zipper 102, arms 104, and two front panels 106 which are fabricated in accordance with the present invention. According to one aspect of the present invention, each front panel 106 is preferably made of an air impervious sheet and includes an interior void region 108, which forms a venting opening, allowing air to pass through the panel 106. As shown in FIGS. 2, 2A and 2B, the interior void region 108 is defined by a border, which includes two opposing side portions 112 and 114, a top portion 116 extending between first ends of the two opposing side portions 112 and 114, and a bottom portion 118 extending between the second ends of the two opposing side portions 112 and 114. FIG. 1 illustrates a preferred embodiment, in which the interior void region 108 has a rectangular shape. Those skilled in the art will appreciate that the interior void region 108 can be of any shape, for example, trapezoidal shape, which provides the garment with a venting opening, as well as aesthetic appeal and simplicity of design.

As shown in FIGS. 2–2B, a first at least partially air permeable sheet 120 spans the interior void region 108. The peripheral edges, including two side edges 122 and 124, a top edge 126, and a bottom edge 128, of the permeable sheet 120 are respectively attached to the side, top and bottom portions of the interior void region 108 by stitches or by other means. The first air permeable sheet 120 is preferably entirely air permeable, but also can be partially air permeable. The sheet 120 is made of an air permeable material, such as a mesh or otherwise perforated material, which admits air into and out of the garment.

A second at least partially air permeable sheet 130 is disposed over the first air permeable sheet 120, forming a pocket with the first air permeable sheet 120. In the embodiment shown in the figures, in which the interior void region 108 has a rectangular shape, the second at least partially air permeable sheet 130 includes two opposing edges 132 and 134 coupled to the two opposing side portions 112 and 114 of the interior void region 108, and a bottom edge 138 coupled to the bottom portion 118 of the interior void region 108. The top edge 126 of the first air permeable sheet 120 and the top portion 126 of the interior void region 108 define an opening for the pocket formed by the two air permeable sheets 120 and 130. The second air permeable sheet 130 can be entirely air permeable or partially air permeable, and is also made of a mesh or other air permeable materials.

In another preferred embodiment, the two opposing side edges 132, 134 and the bottom edge 138 of the second air permeable sheet 130 are coupled to the two opposing side portions 112, 114 and the bottom portion 118 of the interior void region 108 by peripheral panels. The peripheral panels include two opposing side panels 135A, 135B and one bottom panel 135C. In one preferred form, the two opposing edges 132 and 134 of the second air permeable sheet 130 are connected to one side of the two side panels 135A and 135B, and the two opposing side portions 112 and 114 of the interior void region 108 are connected to the opposite side of the side panels 135A and 135B, and the bottom edge 138 of the second air permeable sheet 130 is connected to one side of the bottom panel 135C, and the bottom portion 118 of the interior portion 108 is connected to the other side of the bottom panel 135C, thereby the first air permeable sheet 120, the second air permeable sheet 130, and the peripheral panels 135A, 135B and 135C form the pocket, which has a height H. The height H of the pocket may be zero (no peripheral panels) or any other values as desired. The peripheral panels 135A, 135B and 135C are preferably air impermeable.

The panel 100 further includes a flexible air impervious cover sheet 140 disposable over the second air permeable sheet 130. The cover sheet 140 includes a top edge 146 fixedly coupled to the second air permeable sheet 130 near the top edge 136 thereof. The cover sheet 140 also includes two opposing side edges 142 and 144, and a bottom edge 148 adapted for releasable coupling respectively to the side edges 132, 134 and the bottom edge 138 of the second air permeable sheet 130 when the cover sheet 140 overlies the second air permeable sheet 130.

Figure 3:
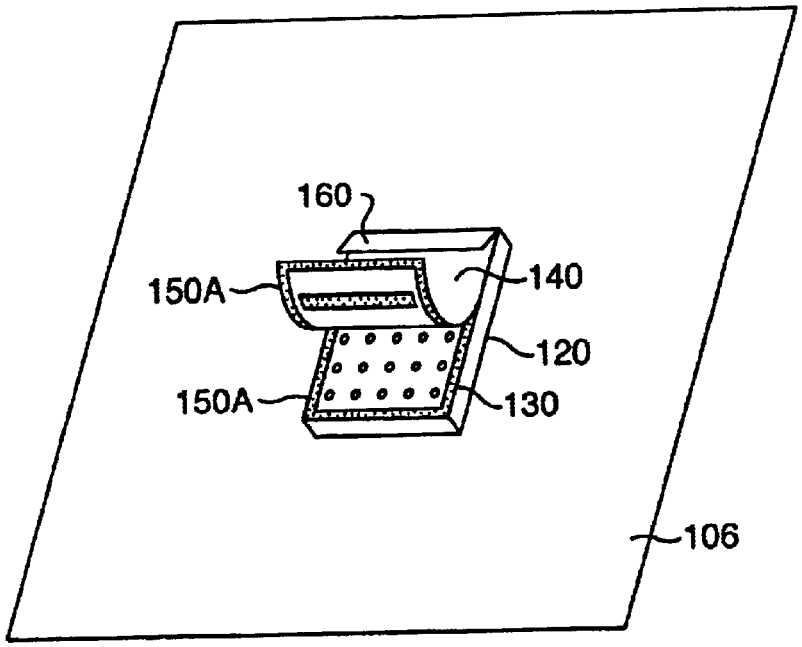
FIG. 3 shows a schematic view of a panel with a cover sheet partially rolled up to show a closure assembly according to one preferred embodiment of the present invention.
Figure 4:
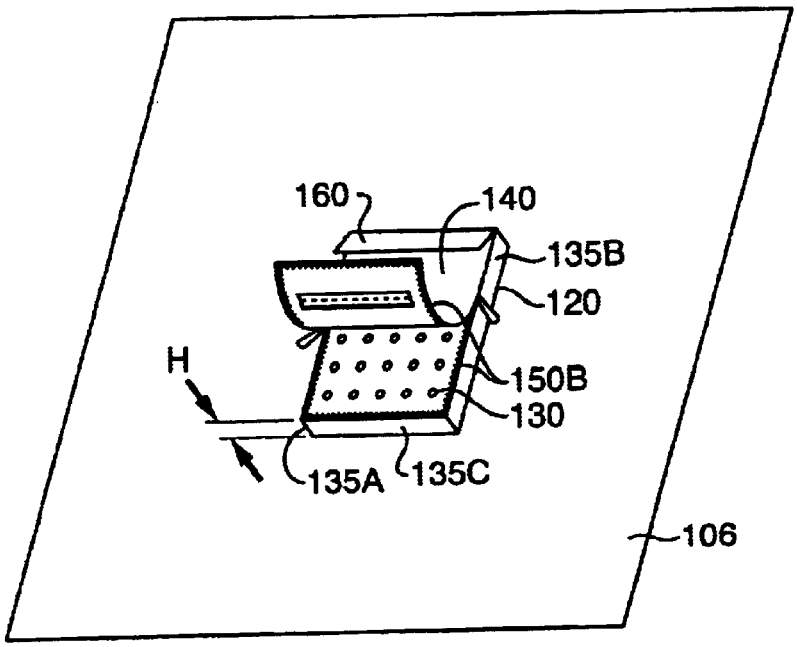
FIG. 4 shows a schematic view of a panel with a cover sheet partially rolled up to show a closure assembly according to another preferred embodiment of the present invention.

A closure assembly 150 extends along the side edges 142 and 144, and the bottom edge 148 of the air impervious cover sheet 140, and along the side edges 132 and 134, and the bottom edge 138 of the second air permeable sheet 130, for attaching the side and bottom edges of the cover sheet 140 to the side and bottom edges of the second air permeable sheet 130. The closure assembly is preferably a hook and loop fastener as denoted by 150A in FIG. 3, or a zipper as denoted by 150B in FIG. 4, such that the side edges 142, 144 and the bottom edge 148 of the cover sheet 140 may be selectively attached to or offset from the side edges 132 and 134 or the bottom edge 138 of the second air permeable sheet 130. When the bottom edge 148 and lower part of the two side edges 142 and 144 of the cover sheet 140 are detached from the bottom edge 138 and side edges 132 and 134 of the second air permeable sheet 130 (e.g., the lower portion of the closure assembly 150 is released), the lower portion of the cover sheet 140 may be rolled up to expose part of the venting opening. By adjusting the closure assembly 150 and the cover sheet 140, a wearer can adjust the venting area of the venting opening and to regulate the airflow into and through the garment. The closure assembly 150 is preferably water proofed, so that when the closure assembly 150 is closed, the garment is water proofed.

Figure 5:
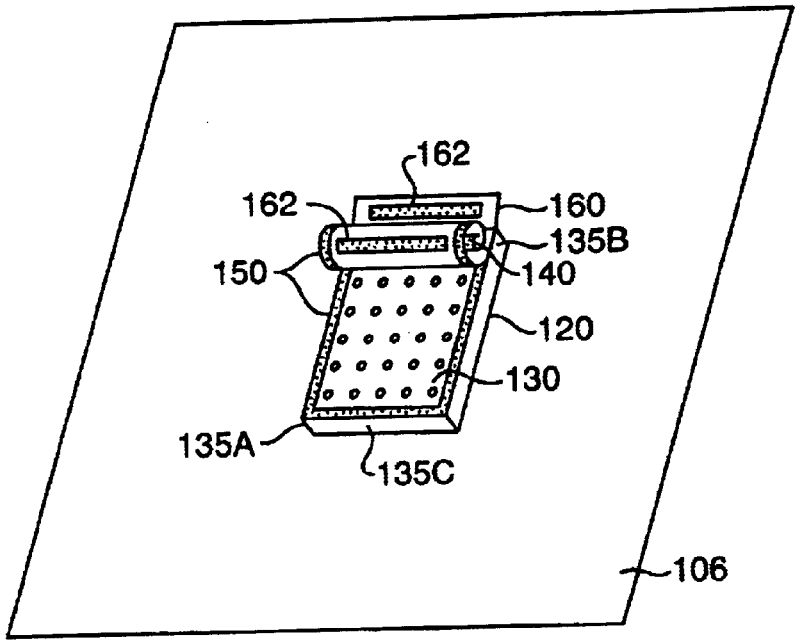
FIG. 5 shows a schematic view of a panel with a cover sheet rolled up, showing a fixation assembly according to one preferred embodiment of the present invention.
Figure 6:
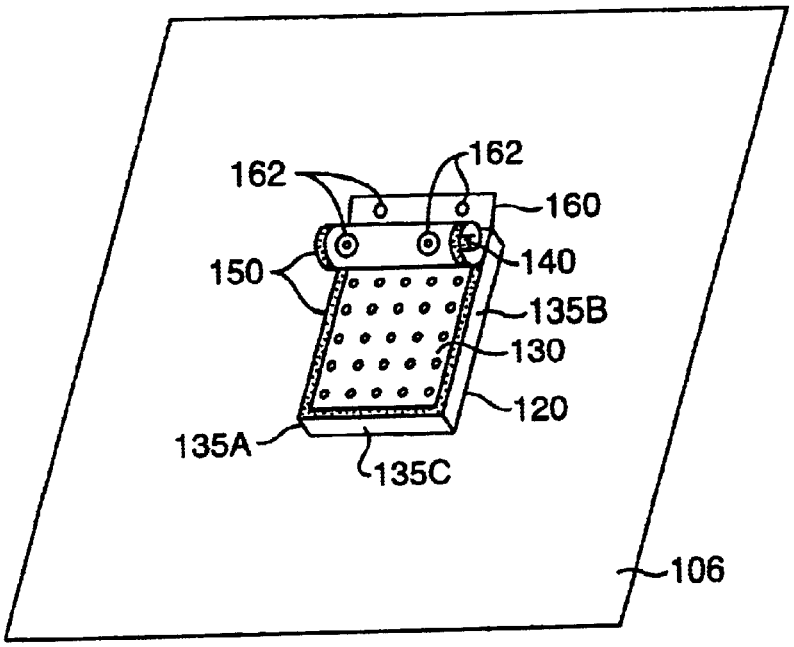
FIG. 6 shows a schematic view of a panel with a cover sheet rolled up, showing a fixation assembly according to another preferred embodiment of the present invention.

The panel 100 further includes a flap 160 extending from the top portion 116 of the border of the interior void region 108 to a distal end. A fixation assembly 162 is disposed on the distal end of the flap 160 and the cover sheet 140. As shown in FIGS. 3–7, when the cover sheet 140 is rolled up to adjust the exposing area of the venting opening, the cover sheet 140 is attached and secured to the flap 160 by the fixation assembly 162. In one preferred embodiment, as shown in FIG. 5, the fixation assembly 162 includes a hook and loop fastener. The hook and loop fastener is mounted on the cover sheet 140 at the back side, which faces the second permeable sheet 130 when the cover sheet 140 overlies the second permeable sheet 130. In an alternative form, the fixation assembly 162 uses a magnetic fastener, as shown in FIG. 6, instead of a hook and loop fastener.

Figure 7:
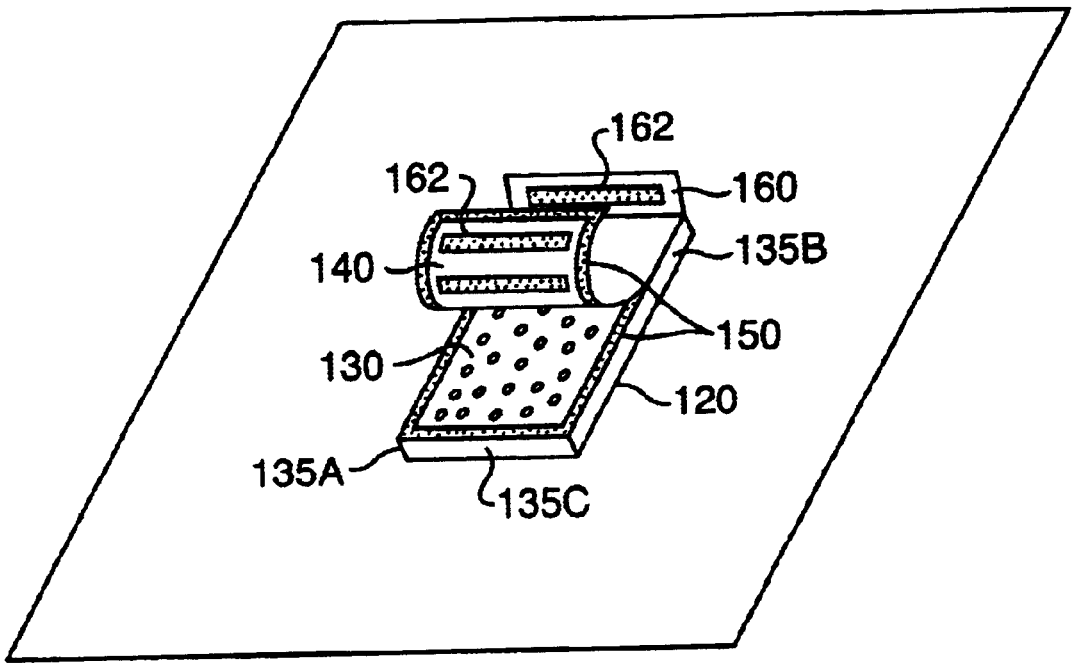
FIG. 7 shows a schematic view of a panel with a cover sheet rolled up, showing a fixation assembly according to a further preferred embodiment of the present invention.

In one preferred form, the hook and loop fastener or the magnetic fastener of the fixation assembly 162 includes a pair of hook and loop tabs or magnetic tabs, one tab attached to the flap 160, and the other tab attached to the back side of the cover sheet 140 near the top edge of the cover sheet 140, so that when the cover sheet 140 is rolled up to fully expose the venting opening, the cover sheet 140 can be attached to the flap 160 by the fixation assembly 162. In another preferred form, as shown in FIG. 7, the fixation assembly 162 may includes an array of hook and loop tabs or magnetic tabs attached the back side of the cover sheet 140, such that when the cover sheet 140 is partially rolled up, the cover sheet 140 also can be attached to the flap 160 by attaching one tab in the array to the tab on the flap 160. By this preferred embodiment, the exposing area of the venting opening can be adjusted by rolling up the cover sheet 140 and selectively coupling one hook and loop tab or magnetic tap on the cover sheet 140 to the associated tab on the flap 160.

The panel with air venting system is used in jacket as illustrated in the figures, but the panel described herein are applicable to any type of garment, including, for example, pants, vests, leggings, chaps, gloves, and full-body suits.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A ventilating panel for a garment comprising:

A. a panel made of an air impervious sheet, said panel having an interior void region defined by a border having two opposing side portions, a top portion extending between first ends of said side portions and a bottom portion extending between second ends of said side portions;

B. a first at least partially air permeable sheet extending from and spanning said interior void region;

C. a second at least partially air permeable sheet having opposing side edges and a bottom edge, coupled respectively to said side and bottom portions of said border, and having a top edge opposite said bottom edge, said first and second sheets forming a pocket having an open end defined by said top portion of said border and said top edge of said second sheet;

D. a flexible air impervious cover sheet disposable over said second air permeable sheet, and having a top edge fixedly coupled to said second air permeable sheet near said top edge thereof, and having two opposing side edges and a bottom edge adapted for releasable coupling respectively to said side edges and said bottom edge of said second air permeable sheet when said flexible air permeable cover sheet overlies said second air permeable sheet.

2. A ventilating panel according to claim 1, further comprising:

E. a closure assembly extending along said side edges and said bottom edge of said air impervious cover sheet and along said side edges and said bottom edge of said second air permeable sheet, whereby said air impervious cover sheet may selectively be offset from said edges of said second air permeable sheet.

3. A ventilating panel according to claim 2 further comprising:

F. a flap extending from said top portion of said border of said interior void region to a distal end;

G. a fixation assembly disposed on said distal end of said flap and on said cover sheet, whereby, when said cover sheet is rolled up, said fixation assembly may selectively be enabled to releasably join said flap to said rolled cover sheet.

4. A ventilating assembly according to claim 3 wherein said fixation assembly is a magnetic fastener.

5. A ventilating assembly according to claim 3 wherein said fixation assembly is a hook and loop fastener.

6. A ventilating panel according to claim 2 wherein said closure assembly is a zipper.

7. A ventilating panel according to claim 2 wherein said closure assembly is a hook and loop fastener.

8. A ventilation assembly according to claim 2, wherein the closure assembly is water proofed.

9. A ventilation assembly according to claim 1, wherein said opposing side edges and said bottom edge of said second at least partially air permeable sheet are coupled respectively to said opposing side portions and bottom portion of said border by two side panels and a bottom panel.

* * * * *